United States Patent [19]

Craddock

[11] Patent Number: 4,955,308

[45] Date of Patent: Sep. 11, 1990

[54] FLOATING BOAT LIFT

[76] Inventor: Gary D. Craddock, 4942 Commonwealth Dr., Sarasota, Fla. 34242

[21] Appl. No.: 472,098

[22] Filed: Jan. 30, 1990

[51] Int. Cl.[5] ..... B63B 35/34

[52] U.S. Cl. ..... 114/45; 405/4

[58] Field of Search ..... 114/44, 45, 46, 47, 114/48, 258, 259, 261, 262, 267; 405/3, 4, 7

[56] References Cited

U.S. PATENT DOCUMENTS

| | | | |
|---|---|---|---|
| 3,951,087 | 4/1976 | Carson | 114/45 |
| 4,072,119 | 2/1978 | Williams | 114/45 |
| 4,132,102 | 3/1988 | Holman et al. | 114/45 |
| 4,686,920 | 8/1987 | Thomas | 114/45 |
| 4,750,444 | 6/1988 | Lemvig | 114/45 |

FOREIGN PATENT DOCUMENTS

| | | | |
|---|---|---|---|
| 8606040 | 10/1986 | World Int. Prop. O. | 114/45 |

*Primary Examiner*—Sherman Basinger

*Assistant Examiner*—Stephen P. Avila

*Attorney, Agent, or Firm*—Charles J. Prescott

[57] ABSTRACT

A floating boat lift for lifting and supporting a boat above the surface of a body of water. The boat lift includes two elongated buoyant pontoons held in spaced apart, generally parallel relation by two transverse, generally U-shaped supports. Each transverse support has a lower, elongated mid portion, side portions upwardly extending from the ends of each mid portion, and upper horizontal end bearing portions which outwardly extend for pivotal connection with the respective pontoons. A cable mechanism is connected between a winch and the transverse supports whereby the supports are pivoted between a first position wherein a cradle connected to the mid portions is elevated above the water's surface and a second position wherein the cradle is submerged. Movement of each mid portion is along an arc defined generally by the length of side portions of each support.

10 Claims, 1 Drawing Sheet

FLOATING BOAT LIFT

BACKGROUND OF THE INVENTION

This invention relates generally to floating docks, and more particularly to a floating boat lift connectable to a fixed or stationary object.

Applicant is aware of a number of boat lifts which are similar in overall function to that of the present invention. One such device is shown in U.S. Pat. No. 3,265,024 to Kramlich which teaches a floating dock having two spaced pontoons in combination with a pair of spaced apart U-shaped brackets. However, this invention actuates the boat cradle for up and down movement differently than that of the present invention.

Another device known to applicant is disclosed in U.S. Pat. No. 4,018,179 to Rutter, a pontoon system utilizing water fillable pontoons for submersion and elevation of the central cradle pontoon portion of this device.

Another invention known to applicant is disclosed in U.S. Pat. No. 4,641,994 to Seal which discloses a side loading boat lift having diagonally disposed rails along which the cradle portion of the invention is made to travel diagonally up and down.

The present invention discloses a simple and economical to manufacture, yet extremely strong and durable, floating boat lift which utilizes a single winch and economical flexible cable in its most advantageous way so as to articulate pivoted side arms of the U-shaped transverse support member to raise and lower a boat thereatop.

BRIEF SUMMARY OF THE INVENTION

This invention is directed to a floating boat lift for lifting and supporting a boat above the surface of a body of water. The boat lift includes two elongated buoyant pontoons held in spaced apart, generally parallel relation by two transverse, generally U-shaped supports. Each transverse support has a lower, elongated mid portion, side portions upwardly extending from the ends of each mid portion, and upper horizontal end bearing portions which outwardly extend for pivotal connection with the respective pontoons. A cable mechanism is connected between a winch and the transverse supports whereby the supports are pivoted between a first position wherein a cradle connected to the mid portions is elevated above the water's surface and a second position wherein the cradle is submerged. Movement of each mid portion is along an arc defined generally by the length of the side portions of each support.

It is therefore an object of this invention to provide a floating boat lift for lifting and holding a boat out of water when not in use.

It is another object of this invention to provide a boat lift which utilizes economical components in a most advantageous and strong application.

It is yet another object of this invention to provide a floating boat lift which removes all components thereof, except for the submerged portion of the pontoons out of water so as to prevent corrosion.

It is yet another object of this invention to provide a floating boat lift which fully utilizes the full water depth available at a particular location with which to maneuver a boat into position for lifting thereatop.

It is yet another object of this invention to provide a floating boat lift that does not have any viewable protruding appurtenances extending above the floating deck level of said lift.

In accordance with these and other objects which will become apparent hereinafter, the instant invention will now be described with reference to the accompanying drawings.

DETAILED DESCRIPTION OF THE INVENTION

Figure 1:
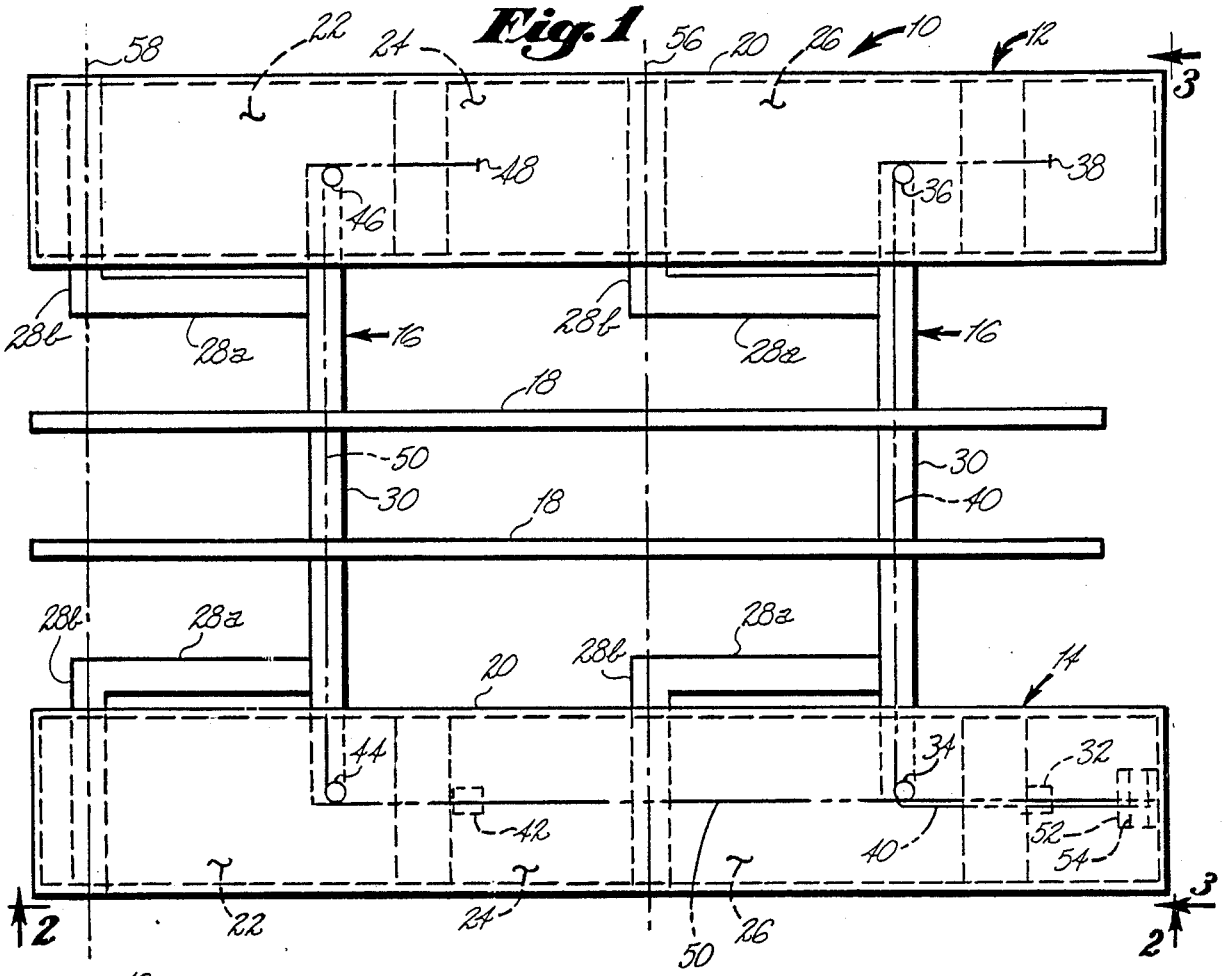
FIG. 1 is a top plan view of the invention.

Referring now to the drawings, the preferred embodiment of the invention is shown generally at numeral 10. This floating boat lift 10 includes two buoyant pontoons 12 and 14, two transverse generally U-shaped rigid supports 16, a longitudinal pair of elongated cradle portions 18 and a winch means 52 mounted in one pontoon 14.

Each buoyant pontoon 12 and 14 includes an upper perimeter frame 20 and three styrofoam buoyant members 22, 24, and 26, fitted within frame 20 as shown. Each U-shaped transverse support 16 includes a lower, elongated mid portion 30, spaced upwardly extending side portions **28*a*, and coaxial upper portions 28*b* which outwardly extend from the upper ends of side portions 28*a*. The lower mid portions 30 extend outwardly beyond side portions 28*a* so that pulleys 34, 36, 44, and 46 are positioned centrally beneath pontoons 12 and 14** as shown.

Figure 2:
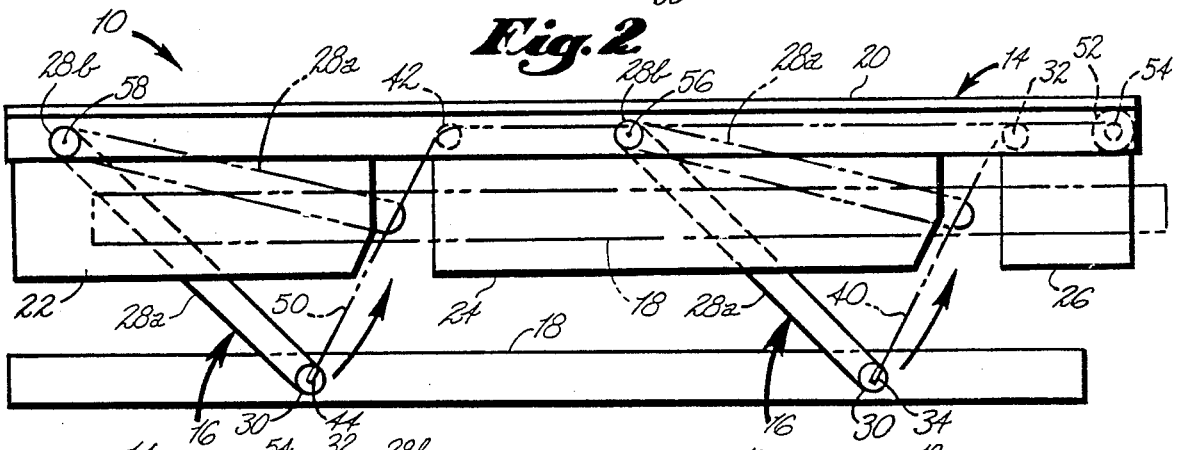
FIG. 2 is a side elevation view in the direction of arrows 2—2 in FIG. 1.
Figure 3:
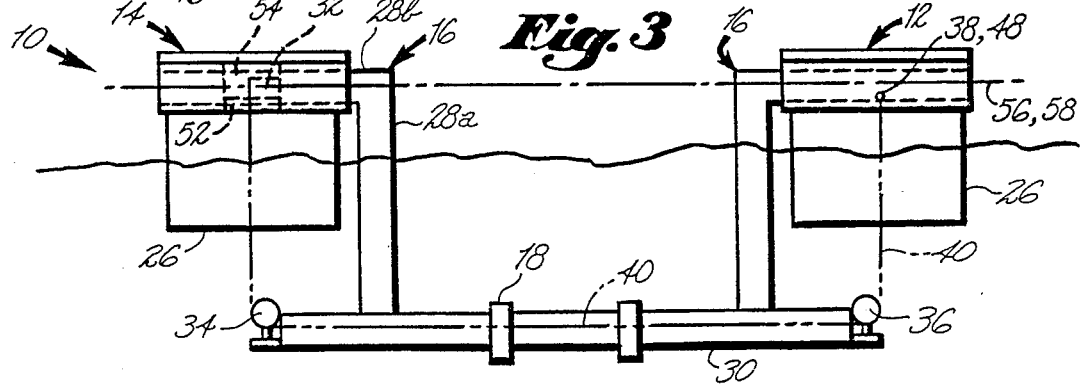
FIG. 3 is a right end elevation view in the direction of arrows 3—3 in FIG. 1.

The outwardly extending upper portions **28*b* of each support 16 are pivotally connected within the corresponding pontoon frame 20 such that each U-shaped member 16 will pivot about axes 56 or 58 in the direction of the arrow shown in FIG. 2. Axis 58 is located near one end of pontoons 12 and 14 as shown, while axis 56 is located at a mid point along the length of pontoons 12 and 14. These axes 56 and 58 are parallel one to another, each coaxial with the corresponding spaced upper end portions 28*b* of one support 16** as shown.

Upper end portions **28*b* are not only pivotally connected within pontoons 12 and 14, but are also secured from axial movement so as to maintain the spaced apart, parallel relationship of pontoons 12 and 14, thus allowing only axial rotation of upper end portions 28*b* within the pontoons 12 and 14**.

Power winch 52 having drum 54 is mounted adjacent one end of pontoon 14 as shown. Two flexible cables 40 and 50 are spooled onto and controlled by, drum 54. Cable 40 extends from drum 54 around pulley 32 mounted in pontoon 14, then down to pulley 34 mounted in one end of lower mid portion 30, then though the hollow length of mid portion 30 to pulley 36 mounted at the other end of mid portion 30, then up to anchor 38 on pontoon 12. Flexible cable 30 extends from drum 54 along the length of pontoon 14 to pulley 42 mounted in pontoon 14, then down to pulley 44 mounted in one end of lower mid portion 30, then through the hollow mid portion 30 to pulley 46 mounted in the other end thereof, then up to anchor 48 at a mid point of pontoon 12.

Thus, by this arrangement, as winch 52 is actuated, cables 40 and 50 act equally on pulleys 34, 36, 44, and 46 so as to cause supports 16 to pivot about axes 56 and 58 as shown to articulate the mid portions 30 up and down in the direction of the arrows in FIG. 2.

It can now be appreciated that the present invention utilizes a winch means and cable means in their most effective environment. Side portions 28*a*, pivoted at one end about axes 56 and 58 are made to pivotally articulate by application of tension force at the distal ends of side portions 28*a* by cable means which results in a mechanical advantage of two in this system so that a boat weighing approximately four times the safe working load of the cable may be lifted if balanced on supports 16.

Longitudinal cradle portions 18, connected atop mid portions 30 in spaced apart relationship, are thus in ready position to receive a boat driven or moved thereatop when the invention is in its lowered position and side portions 28*a* are generally downwardly positioned and upright. When winch 52 is activated, cables 40 and 50 pivot supports 16 about axes 56 and 58 in the direction of arrows shown in FIG. 2 so as to fully upwardly pull the lower mid portions 30 of supports 16 up toward pulleys 32 and 42, respectively.

A particular aesthetic feature of the present invention may now also be appreciated. That feature resides in the fact that no substantial structure above the pontoons 12 and 14 is required to affect lifting of the boat atop cradle portions 18 out of the water. Thus, the present invention is virtually completely unobtrusive when placed in a canal or back yard setting. Likewise, this invention also takes full advantage of the water depth by being capable of placing the cradle portions 18 very nearly atop the water's bottom if side portions 28*a* are of sufficient length.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A floating boat lift for lifting and supporting a boat above the surface of a body of water comprising: p1 first and second elongated buoyant pontoons;

first and second generally U-shaped, spaced apart, rigid transverse supports each having a lower generally horizontal elongated mid portion, side portions upwardly extending from each end of said mid portion, and upper horizontal end bearing portions coaxial one to another about a first and second transverse axis and outwardly extending from the upper ends of each said side portion;

each said mid portion connected to a boat cradle atop which the boat is supportable;

two of said end bearing portions on one side of said mid portions held for rotation about spaced apart parallel said first and second axes within said first pontoon, the other two said end portions on the other side of said mid portions also held for rotation about said first and second axes within said second pontoon whereby said first and second pontoons are held in spaced apart relationship on either side of said first and second transverse supports;

said first and second transverse supports pivotable by rotation about said end bearing portions within said first and second pontoons between a first position wherein said cradles are elevated above the surface of the water and a second position wherein said cradles are submerged and wherein movement of each mid portion is along an arch having a radius generally equal to the length of said side portions;

cable means connected between a winch and each said mid portion for moving said transverse supports in unison between said first and second positions.

2. A floating boat lift as set forth in claim 1, wherein:

said winch is operably mounted in said first pontoon;

said cable means is a first and second length of flexible cable;

said first length of cable is connected at one end to said winch and extends from said winch to a first pulley operably mounted in said first pontoon, then to a second pulley operably mounted in one end of a first said mid portion of said first transverse support, then along said first mid portion to a third pulley operably mounted in the other end of said first mid portion, then to said second pontoon where the other end of said first cable is connected at a point on said second pontoon corresponding to a location on said first pontoon of said first pulley;

said second length of cable connected at one end to said winch and extending from said winch to a fourth pulley operably mounted in said first pontoon spaced from said first pulley, then to a fifth pulley operably mounted in one end of a second said mid portion of said second transverse support, then along said second mid portion to a sixth pulley operably mounted in the other end of said second mid portion, then to said second pontoon where the other end of said second cable is connected at a point on said second pontoon corresponding to a location on said first pontoon of said fourth pulley.

3. A floating boat as set forth in claim 2, wherein:

said first axis is positioned at a mid point along the length of said first and second pontoons;

said second axis is positioned near one end of said first and second pontoons;

said first pulley and said end connection of said first cable to said second pontoon are positioned near the other ends of said first and second pontoons, respectively;

said fourth pulley and said end connection of said second cable to said second pontoon are positioned at a mid point of said first and second pontoons, respectively, and between said first and second axes;

said first and second mid portions are positioned adjacent said first and fourth pulleys, respectively, when said first and second transverse supports are in said first position.

4. A floating boat lift as set forth in claim 3, wherein:

said first and second mid portions outwardly extend beyond said respective side portions;

said first, second and fourth pulleys are positioned centrally below the longitudinal axis of said first pontoon;

said third and sixth pulleys are positioned centrally with respect to the longitudinal axis of said second pontoon.

5. A floating boat lift as set forth in claim 1, wherein:

said cable means is connected between said winch and each of said side portions.

6. A floating boat lift for lifting and supporting a boat above the surface of a body of water comprising:

first and second elongated buoyant pontoons;

first and second generally U-shaped, spaced apart, rigid transverse supports each having a lower generally horizontal elongated mid portion, side portions upwardly extending from each end of said mid portion, and upper horizontal end bearing portions coaxial one to another about a first and second transverse axis and outwardly extending from the upper ends of each said side portion;

each said mid portions pivotally interconnected by an elongated longitudinal boat cradle atop which the boat is supportable;

two of said end bearing portions on one side of said cradle held for rotation about spaced apart parallel said first and second axes within said first pontoon, the other two said end portions on the other side of said cradle also held for rotation about said first and second axes within said second pontoon whereby said first and second pontoons are held in spaced apart relationship on either said of said first and second transverse supports; said first and second transverse supports pivotable in unison by rotation about said end bearing portions within said first and second pontoons between a first position wherein said cradle is elevated above the surface of the water and a second position wherein said cradle is submerged and wherein movement of each mid portion is along an arch having a radius generally equal to the length of said side portions;

cable means connected between a winch and each said mid portion for moving said transverse supports in unison between said first and second positions.

7. A floating boat lift as set forth in claim 6, wherein:

said winch is operably mounted in said first pontoon;

said cable means is a first and second length of flexible cable;

said first length of cable is connected at one end to said winch and extends from said winch to a first pulley operably mounted in said first pontoon, then to a second pulley operably mounted in one end of a first said mid portion of said first transverse support, then along said first mid portion to a third pulley operably mounted in the other end of said first mid portion, then to said second pontoon where the other end of said first cable is connected at a point on said second pontoon corresponding to a location on said first pontoon of said first pulley;

said second length of cable connected at one end to said winch and extending from said winch to a fourth pulley operably mounted in said first pontoon spaced from said first pulley, then to a fifth pulley operably mounted in one end of a second said mid portion of said second transverse support, then along said second mid portion to a sixth pulley operably mounted in the other end of said second mid portion, then to said second pontoon where the other end of said second cable is connected at a point on said second pontoon corresponding to a location on said first pontoon of said fourth pulley.

8. A as set forth in claim 7 wherein:

said first axis is positioned at a mid point along the length of said first and second pontoons;

said second axis is positioned near one end of said first and second pontoons;

said first pulley and said end connection of said first cable to said second pontoon are positioned near the other ends of said first and second pontoons, respectively;

said fourth pulley and said end connection of said second cable to said second pontoon are positioned at a mid point of said first and second pontoons, respectively, and between said first and second axes;

said first and second mid portions are positioned adjacent said first and fourth pulleys, respectively, when said first and second transverse supports are in said first position.

9. A floating boat lift as set forth in claim 8, wherein:

said first and second mid portions outwardly extend beyond said respective side portions;

said first, second and fourth pulleys are positioned centrally below the longitudinal axis of said first pontoon;

said third and sixth pulleys are positioned centrally with respect to the longitudinal axis of said second pontoon.

10. A floating boat lift as set forth in claim 6, wherein:

said cable means is connected between said winch and each of said side portions.

* * * * *